US005487677A

United States Patent [19]

Hoffner

[11] Patent Number: 5,487,677

[45] Date of Patent: Jan. 30, 1996

[54] HERMAPHRODITE ELECTRICAL CONNECTOR

[75] Inventor: Max Hoffner, Hirsingue, France

[73] Assignee: Maxi System International S.A., Mulhouse, France

[21] Appl. No.: 190,174

[22] PCT Filed: Jul. 31, 1992

[86] PCT No.: PCT/FR92/00755

§ 371 Date: Jan. 31, 1994

§ 102(e) Date: Jan. 31, 1994

[87] PCT Pub. No.: WO93/03515

PCT Pub. Date: Feb. 18, 1993

[30] Foreign Application Priority Data

Aug. 8, 1991 [FR] France ..... 91 10228

[51] Int. Cl.[6] ..... H01R 13/627; H01R 23/27

[52] U.S. Cl. ..... 439/293; 439/353; 439/701; 439/737; 439/949

[58] Field of Search ..... 439/284–295, 439/353, 622, 189, 737, 949, 701

[56] References Cited

U.S. PATENT DOCUMENTS

| | | | |
|---|---|---|---|
| 398,769 | 2/1889 | Currie | 439/284 |
| 2,384,267 | 9/1945 | Anderson | 439/293 |
| 3,676,833 | 7/1972 | Johnson | 439/295 |
| 4,089,579 | 5/1978 | Steinbach | 439/353 |
| 4,364,626 | 12/1982 | Price | 439/732 |
| 4,575,704 | 3/1986 | Pezold | 439/622 |

FOREIGN PATENT DOCUMENTS

| | | | |
|---|---|---|---|
| 0052768 | 6/1982 | European Pat. Off. . | |
| 2501918 | 3/1981 | France . | |
| 3315864 | 12/1983 | Germany . | |
| 1109919 | 4/1968 | United Kingdom | 439/737 |

*Primary Examiner*—Neil Abrams
*Attorney, Agent, or Firm*—Davis, Bujold & Streck

[57] ABSTRACT

The invention relates to a hermaphrodite electrical connector providing safe electric power supply wiring without any risk of accidental disconnection. The connector (1) comprises a female contact part (3) provided with a contact socket (6), a male contact part (4) provided with a contact pin (8) and an insulating case (2) surrounding said parts. At the front, the case comprises a male tubular section (5) around the socket (6) and a female tubular section (7) around the pin (8). Said tubular sections are engageable in and on the corresponding sections of another similar connector and comprise locking members (10, 13). A plurality of said connectors (1) may be juxtaposed and mechanically and electrically connected by metal pins 17 in order to form a distribution block (21, 22). Such a connector may be used in electric power supply networks of very low voltage (12 V), low voltage (11, 220 V) or higher voltage.

12 Claims, 2 Drawing Sheets

HERMAPHRODITE ELECTRICAL CONNECTOR

The present invention relates to a hermaphrodite electrical connector for electrical installations, comprising at least one female contact part fitted with a socket, at least one male contact part with a contact pin arranged to fit longitudinally into the socket of the female contact part of another similar connector, and an oblong insulating case which laterally surrounds the said contact parts and which, close to the pin and the socket, has male and female sections arranged to fit into and onto the corresponding sections of the said similar connector. The invention also relates to a connection block comprised of several of these connectors.

The publication FR-A-2 501 918 describes a hermaphrodite connector of this type, for a multiconductor cable used for signal transmission purposes. A male electrical block fitted with several parallel pins and a female electrical block fitted with several parallel sockets are mounted side by side in a case. They have complementary forms. When two of these hermaphrodite connectors are connected together, they can be locked by means of a swivel fitted on one of them. Such a connection system can not be used in a electric power supply network, in particular because it fails to meet the safety standards generally imposed.

For instance, in very low-voltage domestic installations, generally used for lighting purposes by means of halogen lamps placed according to requirements in a showroom, saleroom or on domestic premises, the very low-voltage power supply is provided by means of cables of all types, adjusted on the spot and connected using screwed flanges. Tightening the latter may cause problems and the screws are not protected. The user often fits them himself and adjusts them to adapt the lighting installation as requirements change. Consequently, wirings of this type are not always done under optimum safety conditions with the guarantee that the standards in force will be complied with. If the screws are not sufficiently tightened or back out in time, this causes loose contacts, voltage drops, localised heating or even conductor displacements which might result in short circuits. Furthermore, there is nothing to prevent pole reversal when mounting or transforming the installation. Similar problems arise in low-voltage electric power supply installations (e.g. 110 volts or 220 volts) and higher voltage installations. What is more, some connection boxes do not fully comply with standards in force.

The purpose of this invention is to avoid the above-mentioned drawbacks and enhance the safety of connections, due to a connector which can be connected easily and safely, ensures the correct positioning of the contacts matching up with the respective poles and withstands a pull-out strength (fixed at 50 N by some standards), capable of disconnecting it accidentally. Using such a connector must in particular make it possible to make a very low-voltage, low-voltage or medium-voltage electrical supply network by means of two-pole insulated cables, fitted with a hermaphrodite connector at each end.

With this aim in mind, one of the features of the connector according to the invention is that the case has, on the male and female sections, locking members which are comprised of a flexible (resilient) tab with a lug in one side wall of the case and a lateral recess in the opposite side wall of the case, to receive the said lug of the other similar connector.

Thus, the connector's contact parts are well insulated from one another and from the outside by the case, the male and female sections of the case prevent a pole reversal due to the connector being incorrectly connected, and the case's integrated locking members prevent any risk of accidental disconnection.

In one advantageous implementation of the connector according to the invention, each contact part is crossed by a lateral orifice opposite which the case presents a lateral opening. These lateral orifices are capable of each receiving a transversal pin which ensures both a mechanical and electrical connection on the connector. The said lateral openings of the case can be fitted with removable insulating plugs. The configuration of the two transversal orifices is preferably the same and they are set out symmetrically, so that the connector can be connected, by means of the said transversal pins, to another similar connector juxtaposed in two opposite positions, according to preference.

According to a preferred form of the connector according to the invention, the case's male and female sections comprise two tubular protection sections which are an integral part of the case, laterally surrounding the pin and socket respectively, i.e. a female tubular section and a male tubular section arranged to fit lengthwise into the female tubular section of the similar connector. Preferably, the male tubular section surrounds the socket and the female tubular section surrounds the pin. The elastic tab can be provided in a side wall in the male tubular section with its lug being directed outwards and the lateral recess being an orifice provided in a side wall in the female tubular section.

The two contact parts can be connected up to two insulated conductors respectively which enter the case by the end opposite the one where the pin and socket are located.

In another way, the connector according to the invention is formed by a distribution block comprised of several pairs of contact parts, with each pair being made up of a female contact part and a male contact part, and electrical connections linking the female contact parts together and the male contact parts together.

In another form of implementation, the distribution block comprises a single case containing several juxtaposed pairs of contact parts, in such a way that one end of the conductor presents a row of pins and a row of sockets.

A special form of a connector according to the invention is comprised of two pairs of contact parts connected by means of an electrical fuse link. Preferably, it comprises a pin and a socket at opposite ends of the case and the fuse is a plug-in fuse inserted in a lateral opening in the case, which makes it possible to insert a fuse connector in a power supply line equipped with connectors according to the invention.

Other features and advantages of the present invention will appear in the following description of various forms of implementation, presented by way of non-restrictive examples and with reference to the attached drawings, in which.

Figure 1:
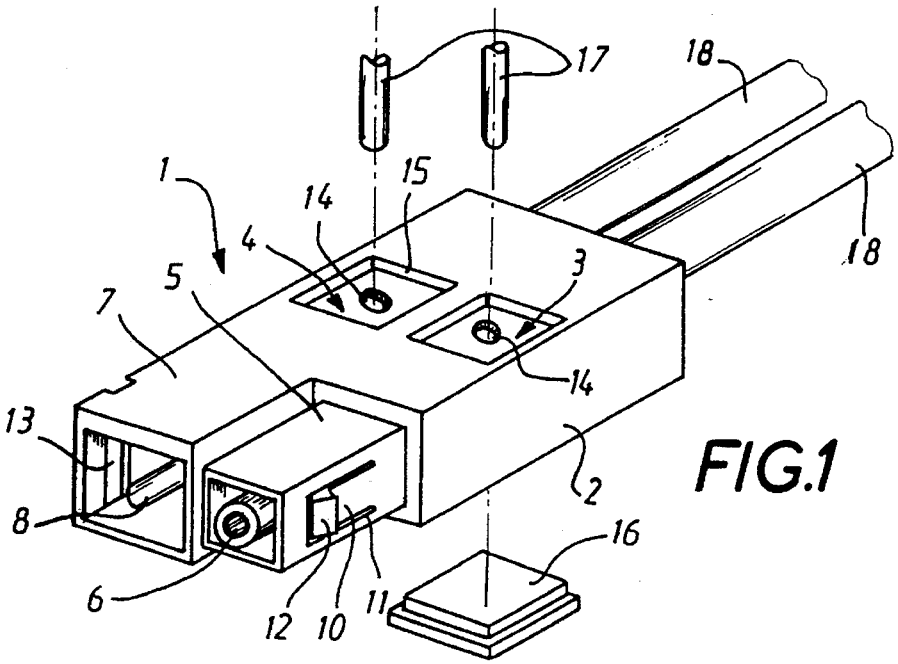
FIG. 1 is a perspective of one type of basic connector according to the invention.

With reference to FIG. 1, the connector 1 which is, for example, of the two-pole type but which could also be three-pole, comprises a case 2 which is more or less rectangular, made of insulating material, which contains a female contact part 3 and a male contact part 4, with these two parts being arranged in parallel in the lengthwise direction of the case 2. The latter has openings at both of its ends. At the front, it has a male tubular section 5 surrounding and protecting a contact socket 6 formed by the front end of the female contact part 3. Parallel to the male section 5, the case presents a female tubular section 7 surrounding and protecting a contact pin 8 which constitutes the front end of the male contact part 4. Both tubular sections 5 and 7 have respective rectangular transversal sections of different sizes, combined in such a way that the male part 5 can fit with little play into the female section 7 of a connector 1 identical to the latter. At the same time, the contact pin 8 of each of the two connectors 1 will fit into the socket 6 of the other connector so as to achieve the electrical connection of each pole. A locking member 10 is formed in a side wall of the male section 5 of the case with a U-shaped slot 11 and it presents an outer lug 12 with a slant at the front. A rectangular orifice 13 is made in the opposite wall of the case's female section 7, so that the lug 12 of a connector 1 opposite latches into it automatically when the two connectors are inserted far enough into each other so that an electrical contact is made between their contact parts 3 and 4 by means of the pins 8 and sockets 6. To unlock when wishing to disconnect the connectors, simply press the lug 12 to unlatch it from the orifice 13.

In the middle part of the connector 1, each contact part 3 and 4 is crossed by a transversal orifice 14 around which the case presents a square opening 15 which can be covered by means of a removable plug 16 in insulating material which is fixed by inserting it into the opening 15. The two orifices 14 are parallel and arranged symmetrically in the connector 1. They can received transversal metal pins 17 which provide mechanical and electrical protection on the connector 1, as will be described later on.

Figure 5:
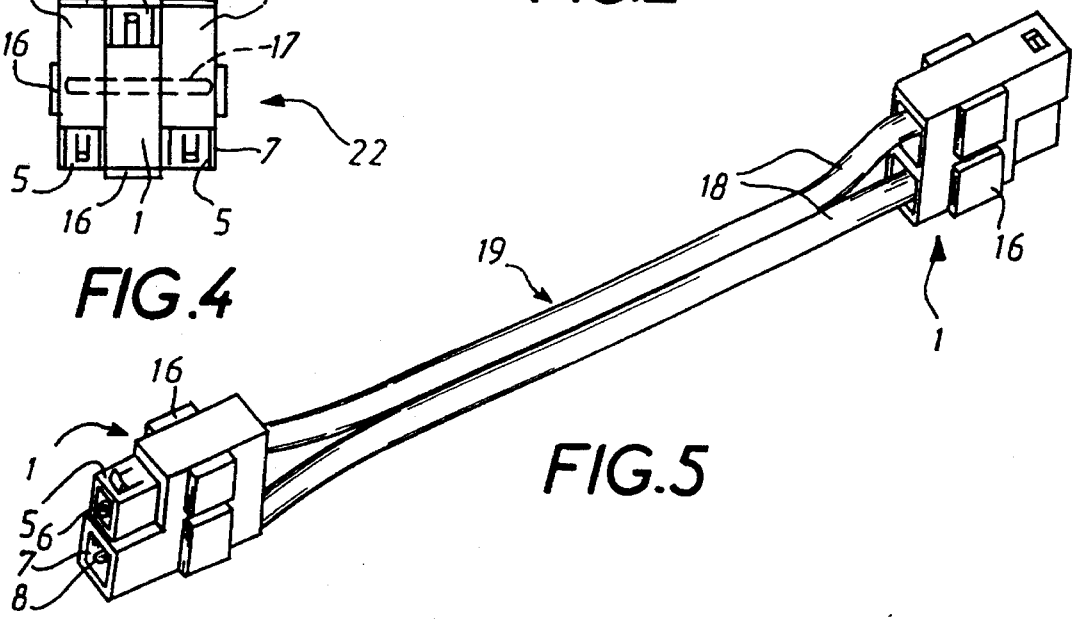
FIG. 5 shows a connecting cord fitted with two connectors of the type shown in FIG. 1.

The rear end of the case 2 comprises two square openings (not shown), opposite the contact parts 3 and 4, which are similar to the openings 15 and capable of being blanked by means of similar plugs 16. In the example shown here, the two rear openings are crossed by insulated conductors 18 connected to the contact parts 3 and 4 respectively in a known manner, e.g. by fastening with screws, crimping and/or soldering. FIG. 5 illustrates an example where the two conductors 18 together form a cord 19 equipped with a hermaphrodite connector 1 at each end. On these connectors 1, the lateral openings are blanked by means of plugs 16, in such a way that all the current carrying parts are efficiently protected from the outside by insulating elements.

Figure 2:
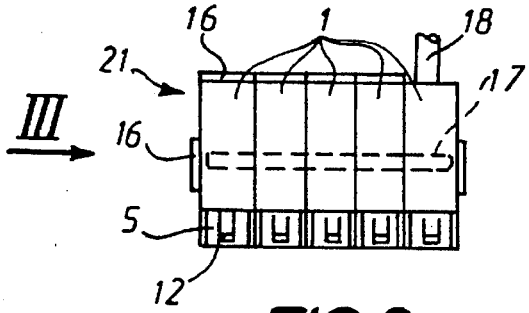
FIG. 2 is a plan view of a distribution block comprised of several juxtaposed basic connectors, of the type shown by FIG. 1.
Figure 3:
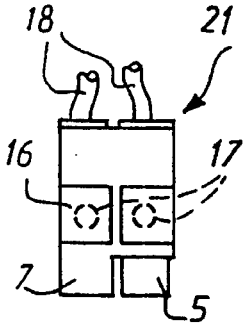
FIG. 3 is a side view of the connector in FIG. 2, following arrow III.

FIGS. 2 and 3 show a distribution block 21 comprised of five basic connectors 1 which are placed side by side and connected mechanically and electrically by means of two metal pins 17 inserted through the transversal orifices 14 of the five connectors. The pins 17 are held by friction in each orifice 14, e.g. using elastic elements such as rings or steel strips inside the contact parts 3 and 4. The whole block's 21 power supply is provided by a pair of conductors 18 connected to the rear of one of the connectors 1. All the unused openings 15 of the connectors 1 are blanked using square plugs 16, in such a way that the conductors are protected from the outside. Such a connector 21 is used to distribute the power supply in parallel to various users, especially by means of cords such as the one in FIG. 5, and replaces the traditional connection blocks of the "domino" type, where the contact parts and the bare parts of the conductors to be connected are badly protected against accidental contact with an outside object.

Figure 4:
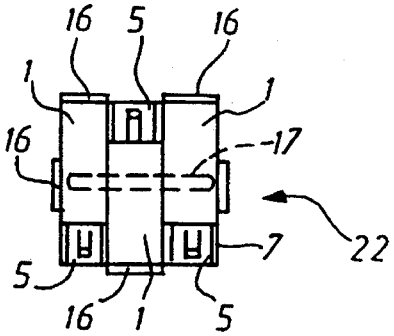
FIG. 4 is a similar view to FIG. 2, showing a distribution block which is arranged differently.

While the parts 1 of the connector 21 all have the same orientation, FIG. 4 shows another distribution block 22 which is made up of three basic connectors 1 which do not all have the same orientation. In actual fact, the middle connector is pointing in the opposite direction to the other two, which may facilitate the connection of cords distributing electricity in various directions. For instance, the middle connector can be connected to a power supply cord, whereas the other two can be connected to two respective lamps directly or via cords.

Figure 6:
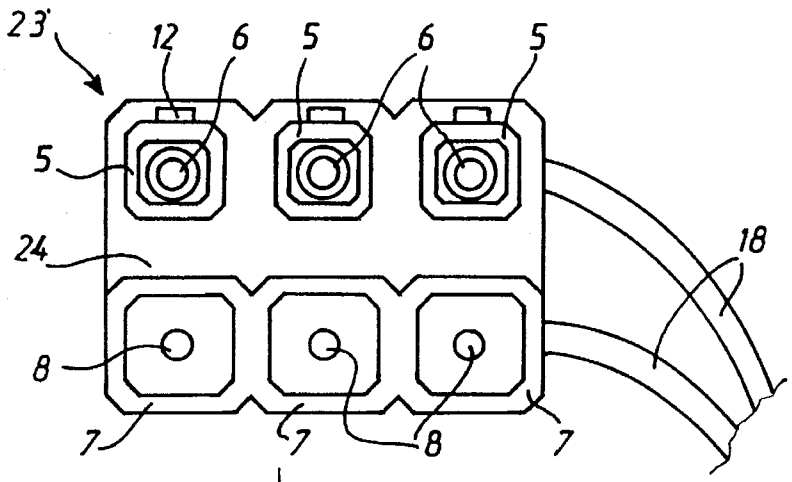
FIG. 6 is a front view of another type of distribution block.

FIG. 6 shows a front view of a distribution block 23 with for example three pairs of contact parts with three sockets 6 and three pins 8 arranged in the same way as in the connector 21 in FIGS. 2 and 3, but mounted in a joint case 24 provided with three sets of male 5 and female 7 tubular sections protecting the sockets and pins. One of the pairs of contact parts is connected to a pair of insulated conductors 18 and to the other two pairs inside the case 24. The case can be completely closed except for the free end of the tubular sections 5 and 7, in such a way that no current carrying part will be accessible from the outside when the connectors are connected onto the latter's three pairs of contact parts. Distribution blocks like this one can be made with any number of pairs of contact parts and be connected to connectors with a different number of these contact parts, e.g. the connectors 1, 21 or 22 described above.

Figure 8:
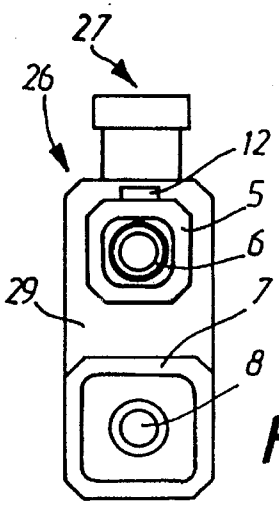
FIG. 8 is an end view of the connector following arrow VIII in FIG. 7.
Figure 7:
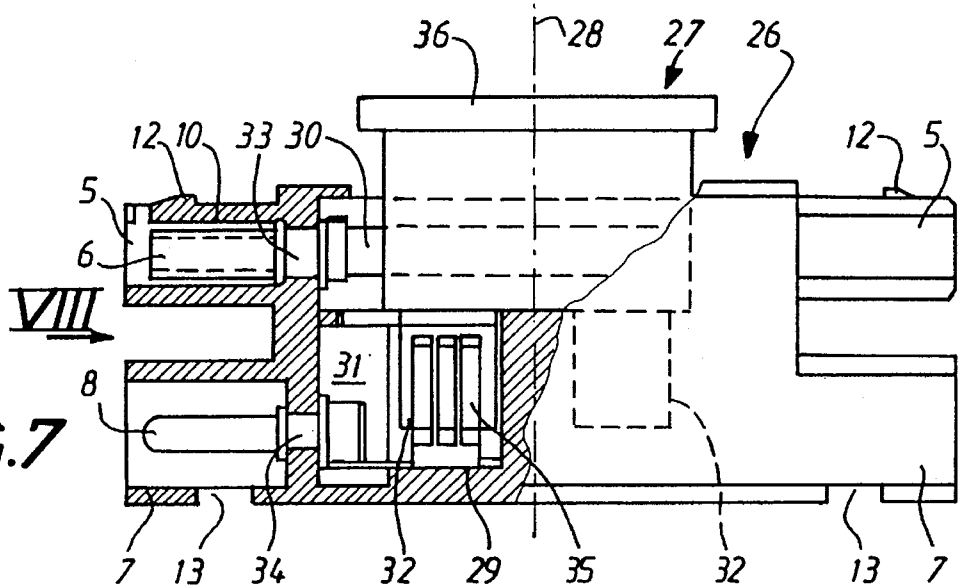
FIG. 7 is a partially cut away side view of a double connector equipped with a fuse.

FIGS. 7 and 8 show a double connector 26 fitted with a removable fuse and capable of being inserted on a power supply line, between two connectors as described above. The connector 26 is symmetrical in relation to its transversal mid-plane 28; in particular, each of its ends comprises a female contact part 33 with a socket 6, a male contact part 34 with a pin 8, inside an insulating case 29 provided with male sections 5 and female sections 7 as in the case of the connector. The two female parts 33 are connected electrically by a metal strip 30 arranged laterally inside a middle cavity 31 in the case, next to the fuse 27. The latter is a known type of plug-in fuse, equipped with metal tabs 32 which are inserted between the elastic clips 35 of each contact part 34. The head of the fuse remains visible at the end of the case 29 to enable the fuse to be replaced easily; furthermore, the rated amperage is shown on the fuse. Due to its ease of assembly and versatility of application, this kind of fuse connector makes it possible to enhance the operational reliability of a domestic power supply network, especially when combined with distribution blocks, as it is then possible to individually protect the various pieces of apparatus being fed or the various circuits, particularly the very low-voltage secondary circuits, against overcharges.

This invention is not restricted to the examples of implementation and application mentioned above, but can be widened to include any modification or variation which is obvious for the expert.

In particular, male and female sections can be designed, which are different from the sections 5 and 7, with any profiles whatsoever fitting together. Connectors according to the invention can be incorporated into equipment fixtures, e.g. to make it possible to directly connect halogen lamps, spotlights, etc. Connectors according to the invention can be made with any voltage, a.c. or d.c., including battery fed networks. In order to comply with certain standards or regulations, the polarities can be identified by means of cables with the appropriate colours.

I claim:

1. Hermaphrodite electrical connector (1, 21, 22, 23, 26) comprising at least one female contact part (3, 33) fitted with a socket (6) arranged to fit longitudinally onto a pin of a male contact part of another similar connector, at least one male contact part (4, 34) with a pin (8) arranged to fit longitudinally into the socket (6) of the female contact part of a another similar connector, and an oblong insulating case (2, 24, 29) which laterally surrounds the said contact parts and which presents, close to the pin and the socket, male and female sections arranged to fit into and onto the corresponding sections of the said similar connector turned of 180°, characterised in that:

the said male and female sections of the case comprise two tubular protection and insulating sections (5, 7), which form an integral part of the case (2, 24, 29), the male tubular section (5) surrounding the socket (6) and the female tubular section (7) surrounding the pin (8);

the case (2, 24, 29) comprises, on the said male and female tubular sections (5, 7) locking members comprised of a resilient tab (10) with a lug (12) on one side of the case and a lateral recess on the opposite side of the case to receive the said lug of the other similar connector; and the said resilient tab (10) is provided in a wall of the male tubular section (5), with its lug (12) pointing outwards, and the said lateral recess (13) is an orifice provided in a wall of the female tubular section (7).

2. Connector according to claim 1, characterised in that each contact part (3, 4) is crossed by a transversal orifice (14) opposite which the case (2) presents a lateral opening (15), with the said transversal orifices being capable of each receiving a transversal pin (17) providing mechanical and electrical connection on the connector.

3. Connector according to claim 2, characterised in that the case's said lateral openings (15) are fitted with removable insulating plugs (16).

4. Connector according to claim 2, characterised in that the two transversal orifices (14) have the same configuration and are arranged symmetrically, in such a way that the connector (1) can be connected, by means of the said transversal pins, to another similar juxtaposed connector (1) in two opposite positions, according to preference.

5. Connector according to claim 1, characterised in that the two contact parts (3, 4) are connected respectively to two insulated conductors (18) which enter the case by the end opposite the one where the pin (8) and socket (6) are located.

6. Connector according to claim 1, characterised in that it includes a plurality of said hermaphrodite electrical connectors (1) joined to form a distribution block (21, 22, 23), each connector comprising a pair of contact parts (3, 4) being made of a female contact part (3) and a male contact part (4), and in that the female contact parts (3) and the male contact parts (4) of the connectors are respectively connected to each other by electrical connections (17).

7. Distribution block (21, 22) according to claim 6, characterised in that it comprises a different case (2) for each pair of contact parts (3, 4), that the different cases (2) are juxtaposed and that the pairs of contact parts are connected mechanically and electrically by means of two transversal pins (17) inserted in the said transversal orifices (14).

8. Distribution block (22) according to claim 6, characterised in that at least one of the hermaphrodite electrical connector (1) points in the opposite direction of the other connectors.

9. Distribution block (23) according to claim 6, characterised in that it comprises one single case (24) containing several juxtaposed pairs of contact parts (3, 4), in such a way that one end of the distribution block presents a row of pins (8) and a row of sockets (6).

10. Connector according to claim 1, characterised in that it comprises two pairs of contact parts (33, 34) connected by an electrical connection comprising a fuse (27).

11. Connector according to claim 10, characterised in that it comprises one pin (8) and one socket (6) at opposite ends of the case (29) and that the fuse is a plug-in fuse inserted in a lateral opening in the case.

12. Distribution block (23) according to claim 7, characterised in that at least one of the hermaphrodite electrical connector (1) points in the opposite direction of the other connectors.

* * * * *